US008662935B2

(12) United States Patent
Jouas et al.

(10) Patent No.: US 8,662,935 B2
(45) Date of Patent: Mar. 4, 2014

(54) MINIATURE RECEPTACLE TERMINALS

(75) Inventors: Valerie Jouas, Saulx Marchais (FR); Jean-Louis Duclos, Elancourt (FR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/504,376

(22) PCT Filed: Oct. 26, 2009

(86) PCT No.: PCT/US2009/062084
§ 371 (c)(1),
(2), (4) Date: Jun. 5, 2012

(87) PCT Pub. No.: WO2011/053276
PCT Pub. Date: May 5, 2011

(65) Prior Publication Data
US 2012/0244756 A1 Sep. 27, 2012

(51) Int. Cl.
*H01R 24/00* (2011.01)

(52) U.S. Cl.
USPC ..... 439/660

(58) Field of Classification Search
USPC ..... 439/660, 839, 851, 842–847, 838, 862
See application file for complete search history.

(56) References Cited

U.S. PATENT DOCUMENTS

| | | | | |
|---|---|---|---|---|
| 5,246,390 | A * | 9/1993 | Egenolf | 439/839 |
| 6,062,918 | A | 5/2000 | Myer et al. | |
| 7,252,559 | B1 | 8/2007 | Morello et al. | |
| 7,458,864 | B2 * | 12/2008 | Philipp | 439/851 |
| 7,856,712 | B2 * | 12/2010 | Busies et al. | 29/882 |

FOREIGN PATENT DOCUMENTS

| | | | |
|---|---|---|---|
| FR | 2 794 293 | A1 | 12/2000 |
| WO | WO 00/74176 | A1 | 12/2000 |

OTHER PUBLICATIONS

International Search Report for PCT/US2009/062084.

* cited by examiner

*Primary Examiner* — Jean F Duverne
(74) *Attorney, Agent, or Firm* — Larry I. Golden; Clarence R. Moon

(57) ABSTRACT

This approach generally pertains to a miniature receptacle terminal with a connection section and a mating section. The mating section has a dual primary contact beam component that includes contact springs having resilient contact beams and a secondary beam. Each contact beam has a contact point opposing the opposing wall of the receptacle terminal, which can include a contact bump. A distributed and balanced contact force is exerted on a male terminal pin that is inserted between the primary contact beams and the contact bumps. Overstress protection of the contact spring is provided and the terminal is economical to produce.

12 Claims, 13 Drawing Sheets

MINIATURE RECEPTACLE TERMINALS

BACKGROUND OF THE INVENTION

This present invention generally pertains to receptacle terminals and more particularly to improved miniature receptacle terminals. These receptacle terminals are structured to enhance pin contact engagement or holding force.

DESCRIPTION OF BACKGROUND ART

The automotive market is shifting to downsized, small-footprint types of receptacle terminals. It is generally known that the contact engagement or holding force of receptacle terminals becomes weaker as the terminals become smaller since the contact springs become proportionally smaller. Attempts have been made to increase the contact engagement or holding force of smaller contact springs by stacking smaller contact springs together, for example, employing two contact springs together to double the combined spring thickness in an attempt to double the contact force. Variation of tolerance due to multiple springs, however, often results in unacceptably large variations of contact force and manufacturing control is complicated. Attempts have also been made to reinforce the thickness of the contact springs employing dimples or beads but this approach has also meet with limited success.

Prior art approaches that have not recognized the positives that could be gained by seeking to achieve the objectives or teach solutions as accomplished by the present approach include U.S. Pat. No. 4,973,271 that pertains to a low insertion force electrical contact female terminal comprised of a main body portion with a resilient contact section and a separate movable support member. The movable support member is positioned under the resilient contact portion to minimize insertion force during mating. After mating, the movable body support member is moved to a second position to maximize force and maintain a strong connection. U.S. Pat. No. 5,226,842 relates to a female terminal for connecting to a male terminal having a terminal body with an opening through which the male terminal is inserted in a wire connecting part for connecting to wires. A separate flexible leaf spring element is mounted on the terminal body for pressing the male terminal against the terminal body. Stop means are provided in the terminal body for restraining the center portion of the flex element in a pre-load condition prior to the insertion of the male terminal. U.S. Pat. No. 6,244,910 relates to a box receptacle terminal formed from a stamped blank with a cantilevered contact-spring. The contact-spring is outwardly deflected relative to the receptacle base when mated with a male contact such as a blade or pin terminal.

Other prior art includes the following. U.S. Pat. No. 6,305,992 relates to an electrical contact having a conductor connector region for connection to an electrical conductor wire and a contact region for making contact with a complementary pin contact. The contact region is essentially designed in the form of a box. The contact region has a contact spring arm extended forward that can be pre-stressed. A supporting second spring arm is positioned above the contact spring arm to provide support to the contact spring arm. U.S. Pat. No. 7,059,921 pertains to a single-piece receptacle terminal that comprises contact tines or blades that extend forward from the rear ceiling of the contact area. The tines first twist so they run parallel to the sidewalls such that the sidewalls assist in protecting the contact tines. The terminals have locking tabs and locking surfaces to lock the terminal in the housing. The contact tines also have guide shields protecting the distal end of the contact tines. U.S. Pat. No. 7,217,161 relates to female terminals comprising a main member or frame and a separate spring member. The contact section of the main member has a general box shape with side holes that have shelves for receiving lateral sides of the spring contact member. The contact section also has a downward projection, which forms an overstress protection feature for the spring contact member.

Further prior art includes the following. U.S. Pat. No. 7,223,134 pertains to single-piece contact with a rear zone that connects to an electrical conductor. On the front of the contact is a protective cage with a contact terminal having at least two elastic contact blades that mate with a male terminal. U.S. Pat. No. 7,241,190 relates to box-shaped tubular female terminals comprising a section for connecting to a conducting wire and a section for mating with a male terminal. A contact-spring is disposed within the contact section and the contact-spring is protected from damage by prohibiting access to the leading edge of the contact-spring. The insertion portion of the mating section has a smaller diameter than the remaining portion of the mating section. The leading edge of the contact-spring is positioned above the smaller diameter walls of the insertion portion for protection. U.S. Pat. No. 7,351,122 pertains to a receptacle terminal comprising a contact beam with spring protection members. The contact section is formed with a metal plate having opposing first and second contacts that extend at right angles to each other and thus form an L-shaped cross-section. Both contact-springs apply pressure to a mating terminal to ensure contact pressure between the receptacle terminal and the mating terminal. Japanese Patent Publication No. 2000-231956 relates to a female terminal electrical connector having a wire connecting end and a contact end. This contact is formed from a single metal plate and has an orientation feature for inserting the connector into a housing.

With the present approach, it has been determined that various characteristics of prior art, such as these references, have shortcomings and undesirable attributes, results or effects. The present approach recognizes and addresses matters such as these to provide enhancements not heretofore available. Overall, the present approach provides more fully enhanced miniature contact springs that fall into a so-called miniature category and that provide increased contact force.

More specifically, goals that have been arrived at in accordance with the present approach, while maintaining good manufacturing control and minimizing variation of tolerance, include increasing the contact engagement or holding force of a contact spring. Other goals include protecting the contact spring from damage in its operating environment, protecting the contact spring and the contact pin from damage during insertion of a male contact pin, providing overstress protection for the contact spring, improving material efficiency and polarizing the receptacle terminal for mounting.

SUMMARY OF THE INVENTION

An embodiment of the present approach generally pertains to a mating section of a miniature receptacle terminal. The mating section of this embodiment has two primary contact beams and a single secondary beam augmenting the primary contact beams. The secondary beam is angled slightly more from the receptacle wall than is at least one of the primary contact beams such that the secondary beam contacts the primary contact beam in the unmated position. Each contact beam has a contact point opposing a contact bump on the opposing wall of the receptacle terminal. A distributed and balanced contact force is exerted on a male terminal pin that is inserted between the primary contact beams and the contact bumps. The dual contact beam component permits good manufacturing control and minimizes contact force variation among individual miniature receptacle terminals made according to this embodiment.

In another aspect of an embodiment of the miniature receptacle terminal, the dual contact beam spring contacts are secured from the rear of the mating section improving material efficiency. High terminal performance is obtained with low manufacturing cost.

In an additional aspect of an embodiment of the miniature receptacle terminal, the dual contact beam spring contacts are secured within a box shaped mating section protecting the spring contacts from damage that can be caused by the operating environment.

In a further embodiment or aspect of the miniature receptacle terminal, the mating section has an orientation member, a terminal front stop and primary and secondary lock up surfaces that assist in mounting the miniature terminal within a connector housing. The miniature receptacle terminal can be further secured by a terminal position assurance ("TPA") member that can interact with a side of the receptacle terminal or with an end or front of the receptacle terminal. The orientation member can have a depression protecting the primary contact beams from overstress. Also, the miniature receptacle terminal can have a guide shield to assist in mating and to protect the mating pin from damage during insertion.

In an additional aspect of embodiments of the miniature receptacle terminal, a support bump provides support to the primary contact beams and secondary beam.

Another embodiment or aspect of the miniature receptacle terminal has preload members that are in contact with primary contact beam or beams to provide a biasing force on the primary contact beams in the unmated position.

In another embodiment or aspect of the miniature receptacle terminal, a gap is located between the closest point of proximity of the primary and secondary contact beams in the unmated position.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

Figure 1:
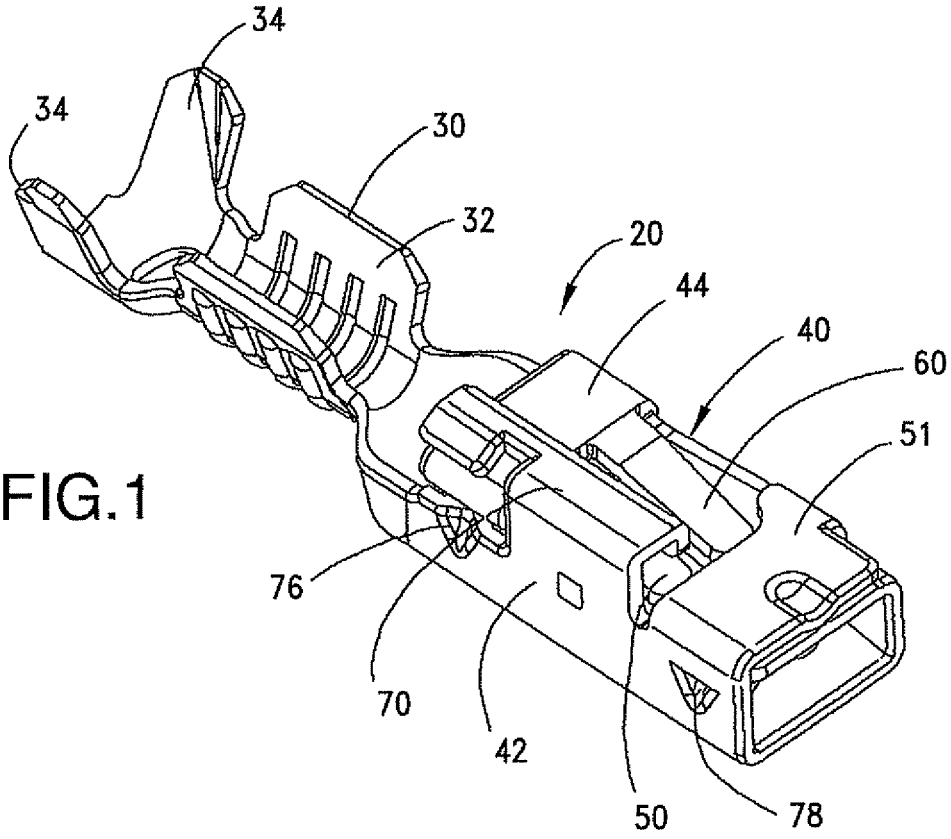
FIG. 1 is a perspective view of a miniature terminal receptacle according to the present approach.
Figure 2:
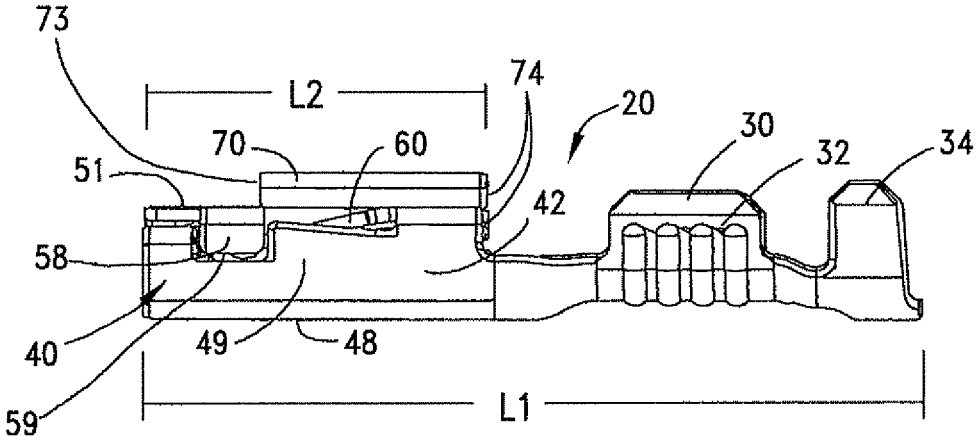
FIG. 2 is a side elevation view of the miniature terminal receptacle shown in FIG. 1.
Figure 3:
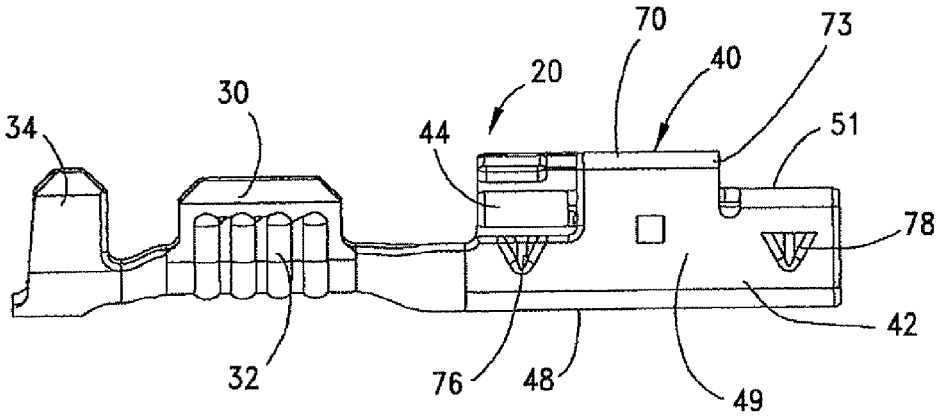
FIG. 3 is an opposite side elevation view of the miniature terminal receptacle shown in FIG. 1.
Figure 4:
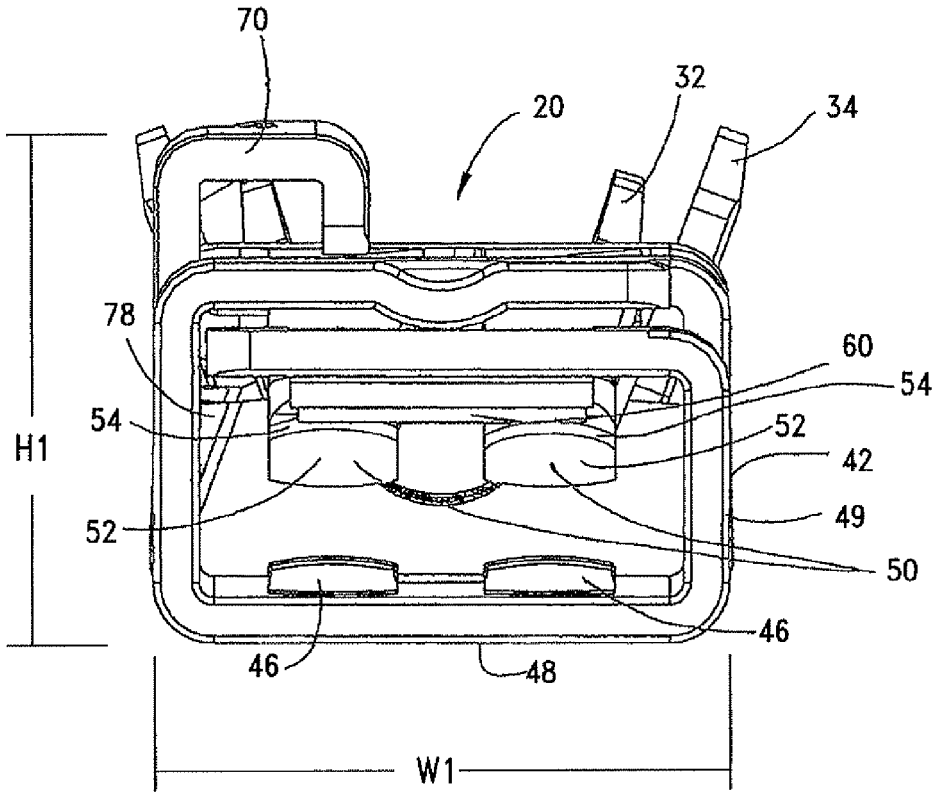
FIG. 4 is a front elevation view of the miniature terminal receptacle shown in FIG. 1.
Figure 5:
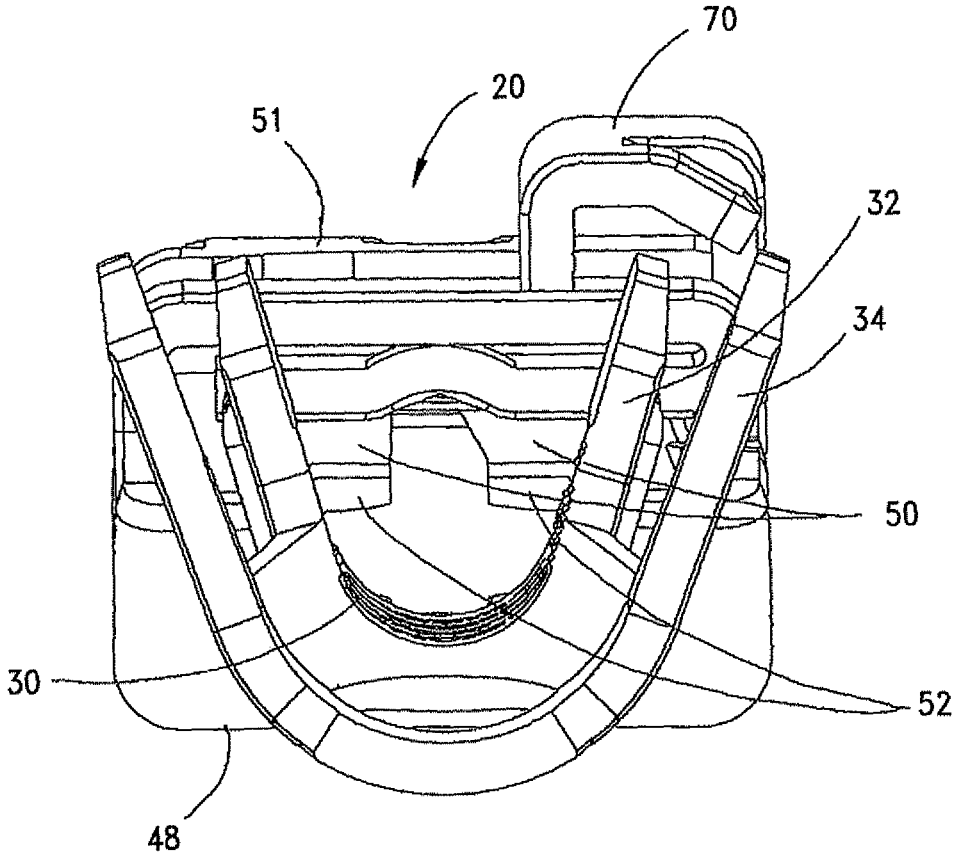
FIG. 5 is a rear elevation view of the miniature terminal receptacle shown in FIG. 1.
Figure 6:
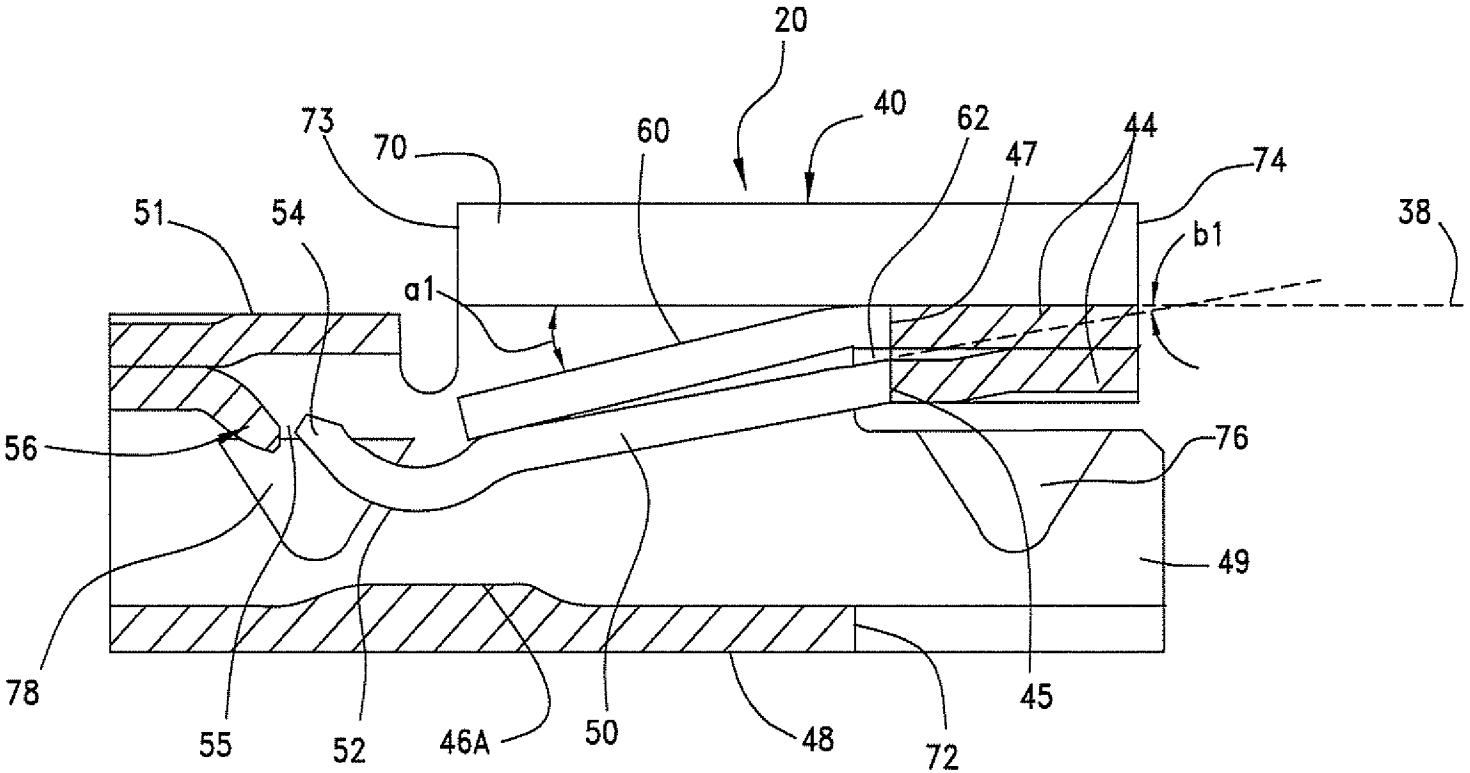
FIG. 6 is a partially cut away side elevation view of the miniature terminal receptacle shown in FIG. 1 in the unmated position.
Figure 7:
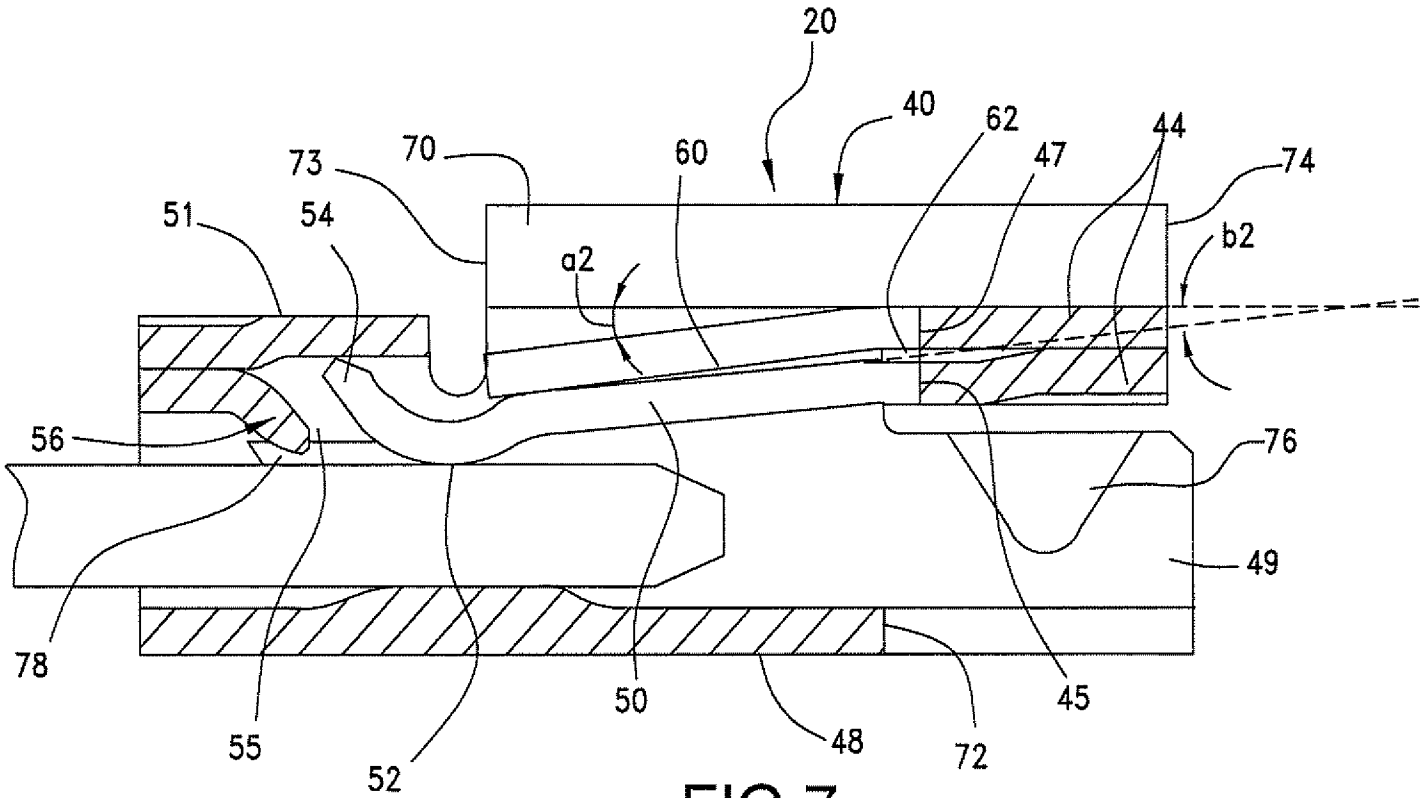
FIG. 7 is a partially cut away side elevation view of the miniature terminal receptacle shown in FIG. 1 in the mated position, shown with a pin inserted therein.

In an embodiment of this approach as shown in FIG. 1 through FIG. 7, miniature receptacle terminals, generally shown as 20, have a connection section 30 for connection to a conductor such as a wire conductor (not shown) and an opposing box-shaped mating section 40 for mating with a complementary male terminal (FIG. 7). Connection section 30 has sidewalls 32 for securely engaging, such as by crimping, to a conductor such as the conductor of an insulated wire. The connection section can have individual arms 34 which can wrap around the insulation of the insulated wire, for example.

Terminal 20 has a length (L1) suitable for a miniature receptacle terminal that can be, for example, between about 17 mm and about 23 mm, suitably between about 18 mm and about 20 mm. Mating section 40 has a body portion, generally shown as 42. Body portion 42 has length (L2) which can be, for instance, between about 6 mm and about 12 mm, suitably between about 7 mm and about 10 mm. Body portion 42 also has width (W1) that can be, for example, between about 3 mm and about 5 mm, typically between about 3.5 mm and about 4.5 mm. Body portion 42, in addition, has height (H1) that can be, for instance, between about 1 mm and about 5 mm, usually between about 2 mm and about 4 mm.

In the illustrated embodiment shown in FIG. 6, unmated miniature receptacle terminal 20 has at least one primary contact beam 50, typically two primary contact beams 50 positioned in parallel within body portion 42. By in effect splitting primary beam in two (or more) narrower beams, insertion force can be reduced when suitable while maintaining advantageous mechanical advantage and angular relationships of the overall beam structure. Primary contact beam or beams 50 are cantilevered from a first location on a support platform 44. Primary beam or beams 50 extend from a longitudinal insertion axis 38 at an angle "b1." A secondary beam 60 is positioned above primary contact beam or beams 50. Secondary beam 60 is cantilevered from a second location on support platform 44, which can be formed by folding a metal blank to provide a first location 45 from which the primary beam extends and a second location 47 from which the secondary beam extends. Secondary beam 60 extends from longitudinal insertion axis 38 at an angle "a1."

In this embodiment, angle "a1" is larger than angle "b1" wherein a portion of secondary beam 60 makes contact with primary contact beam 50 in the unmated position. In a typical example, angle "a1" is between about 5 degrees and 30 degrees, while angle "b1" is between about 1 degree and 25 degrees. As shown, the respective end portions of the respective beams 50 and 60 are spaced apart from each other where these end portions connect to the support platform 44 by a selected distance 62, while their respective free end portions engage each other. It will be noted the selected distance 62 corresponds to the spacing between first location 45 and second location 47 and defines the space or gap between the respective cantilever locations for the beams 50 and 60.

As shown in FIG. 7, contact beams 50 further have a contact surface 52 that engages a male pin 65 when mated within the receptacle terminal. Each contact beam 50 has an upwardly extending tip portion 54 to aid in guiding male pin 65 during insertion and to protect the pin and contact beams 50 from damage. When it is desired to provide overstress protection, upwardly extending tip portion 54 can engage the interior surface of top wall 51 when male pin 65 is inserted, thereby preventing contact beam 50 and top beam 60 from overextending in the upward direction. This engagement between the interior surface and the tip portion can also help provide good contact force by stopping movement of the edge of the tip portion 54 while the curve adjacent thereto on the primary contact beam can provide flexure and bias against the inserted pin 65.

In the non-preloaded embodiment shown in FIGS. 6 and 7, the body portion also has a protective flap 56 to further aid in guiding male pin 65 during insertion and to protect the pin and contact beam 50 from damage. In this illustrated embodiment, protective flap 56 is be sized and shaped to provide a gap 55 between upwardly extending tip 54 and protective flap 56 in the unmated position (FIG. 6) so that the tip portion 54 and flap 56 do not engage each other in normal operation.

Figure 6A:
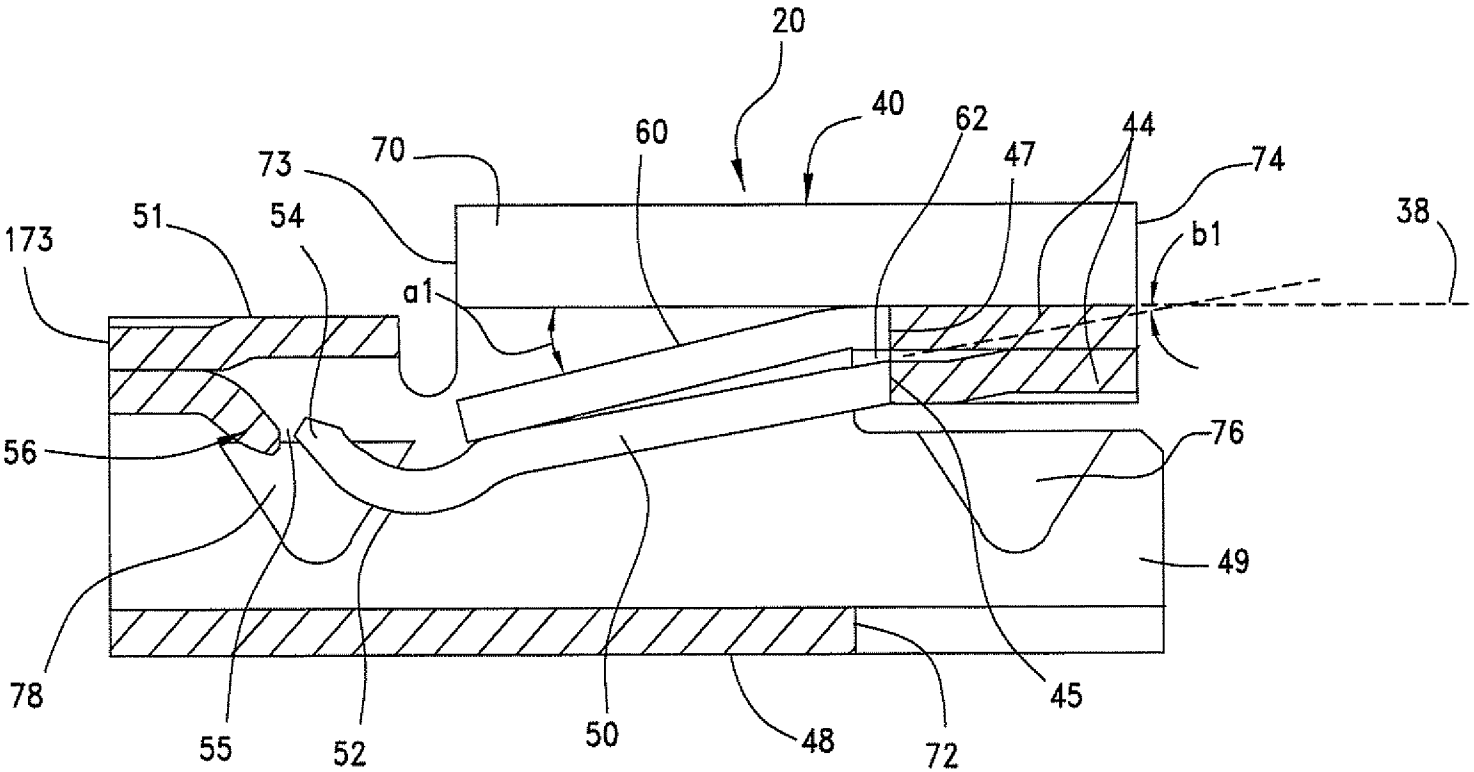
FIG. 6A is a partially cut away side elevation view of another embodiment of a miniature terminal receptacle.
Figure 6B:
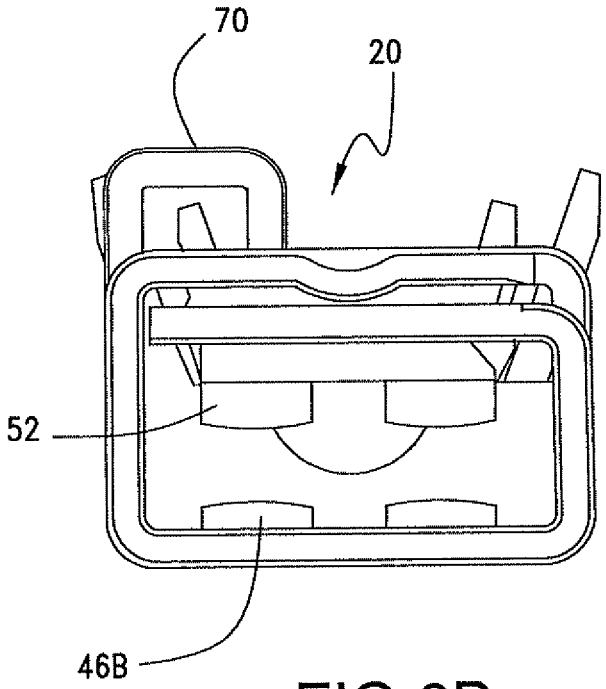
FIG. 6B is a front elevation view of the miniature terminal receptacle showing a variation of the receptacle shown in FIG. 6.
Figure 6C:
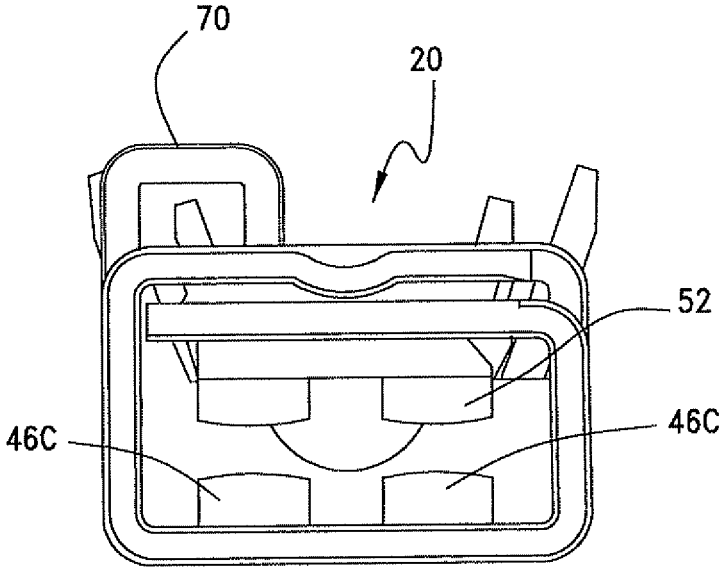
FIG. 6C is a front elevation view of another embodiment showing a variation of the miniature terminal receptacle shown in FIG. 6.

In the illustrated embodiment, body portion 42 further includes a wall 48, considered a bottom wall, with one or more raised or inwardly extending bumps 46A to aid in guiding male pin 65 and to bias the mating pin upwards. As male pin 65 is inserted into mating section 40, male pin 65 is moved towards contact surfaces 52 by one or more bumps 46. The height of each bump can be varied as desired as shown in FIGS. 6B and 6C for example. Varying the height of the bump can allow the force on contact beams 50 to be kept within a specific range while varying the thickness of male pin 65 for example. A lower height of each bump 46B could be used when a thicker male pin 65 is used for example (FIG. 6B). A higher height of bump 46C could be used when a thinner male pin 65 is used for example (FIG. 6C). Alternatively, bottom wall 48 can be without any inwardly extending bumps as shown in FIG. 6A.

As noted in FIG. 7, when male pin 65 is further inserted into mating section 40, male pin 65 engages contact surfaces 52 that are urged to move in a direction considered upward. In the fully mated position, secondary beam 60 extends from support platform 44 at an angle "a2" and each primary contact beam 50 extends away from support platform 44 at an angle "b2," wherein angle "a2" is larger than angle "b2." In a typical example, angle "a2" is between about 1 degree and 20 degrees, while angle "b2" is between about 0 degrees and 15 degrees. Due to the features of the primary contact beam 50 and secondary beam 60 as generally discussed herein, the upward movement of primary contact beam 50 is resisted such that the contact engagement or holding force on the pin increases to levels similar to the pin contact engagement or holding force of larger conventional receptacle terminals that require more bulk to provide a contact engagement or holding force of this magnitude.

Figure 12:
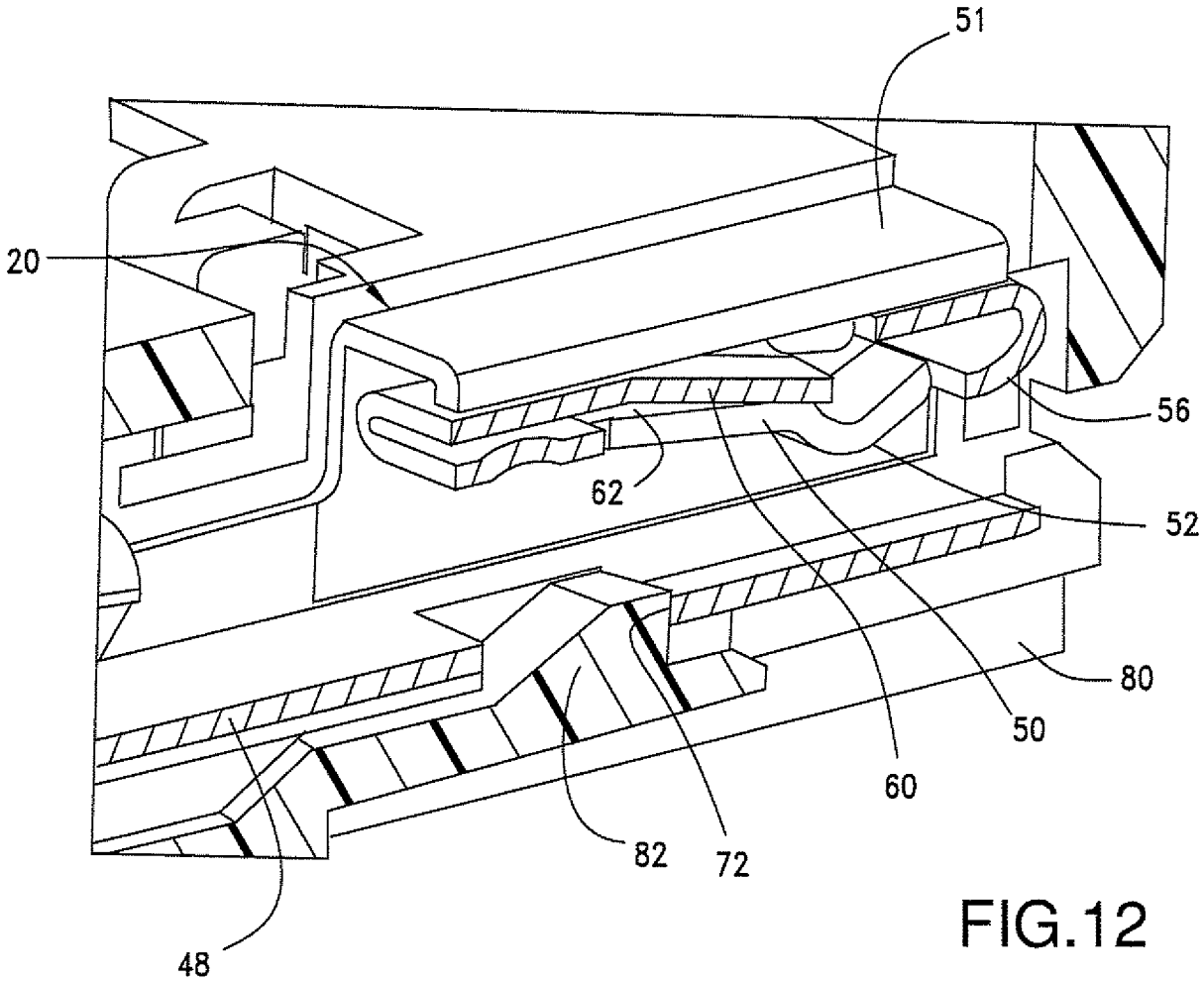
FIG. 12 is a partially cut away perspective view of the miniature terminal receptacle of FIG. 1 inserted into a connector housing.
Figure 13:
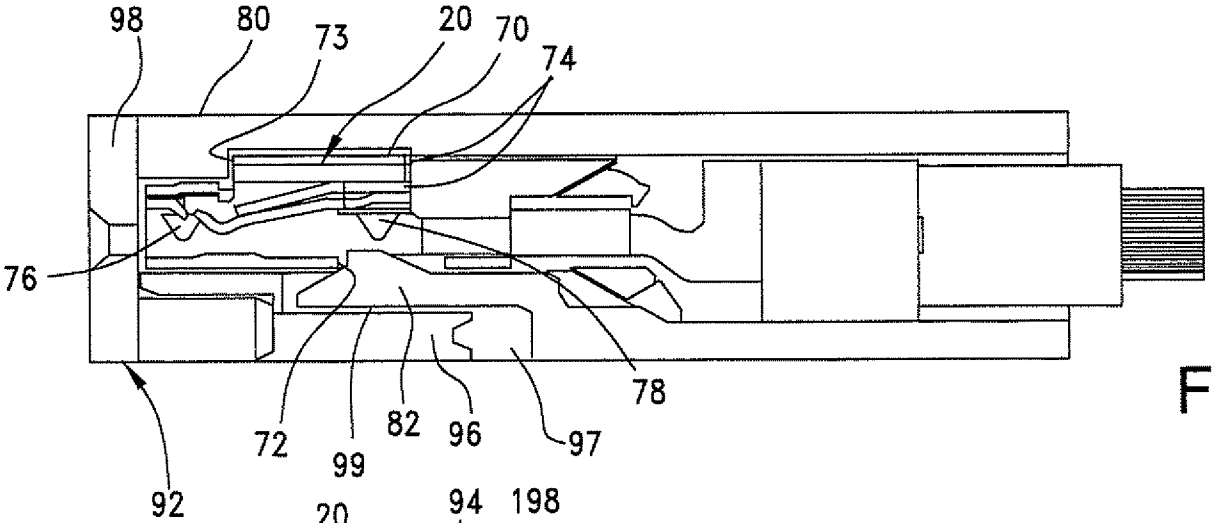
FIG. 13 is a partially cut away side elevation view of another embodiment of a miniature terminal receptacle inserted into a connector housing.
Figure 14:
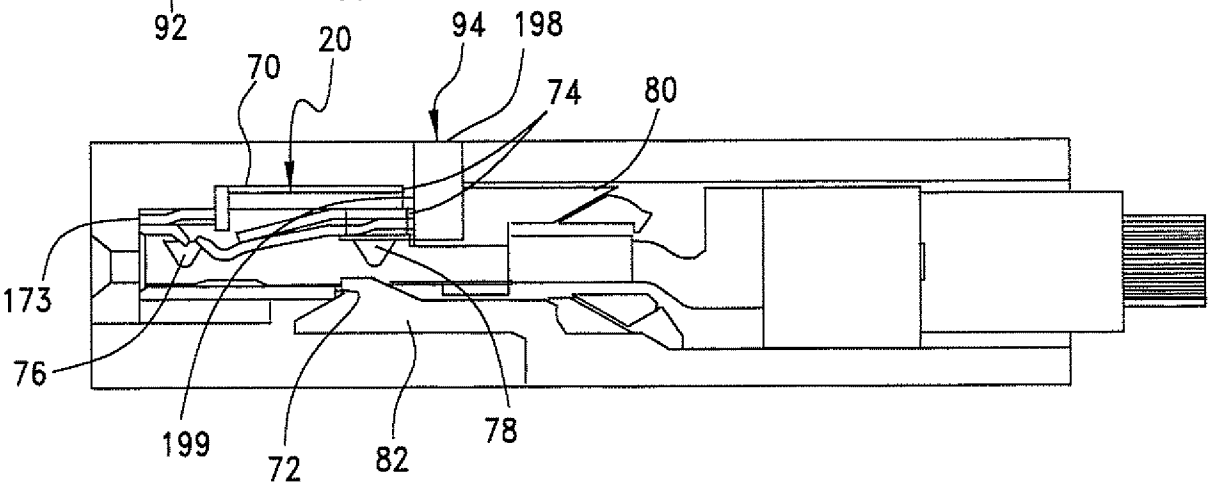
FIG. 14 is a partially cut away side elevation view of another embodiment of a miniature terminal receptacle inserted into a connector housing.

In the illustrated embodiment, bottom wall 48 has a primary lock up surface 72 that can be used to secure the miniature receptacle terminal 20 to a connector housing 80 for example of a type shown in FIG. 12. Top wall 51 has a polarizing projection 70 for proper mounting of receptacle terminal 20 in a connector housing or panel as shown in FIGS. 13 and 14. Polarizing projection 70 extends upward from only a portion of top wall 51. A connector housing may be sized and shaped such that polarizing projection 70 can only be inserted into the connector housing in one particular orientation, thereby ensuring that the miniature receptacle terminal 20 cannot be inserted incorrectly. Top wall 51 also has one or more secondary lock up surfaces 74 that can be used to further secure the miniature receptacle terminal 20 to a connector housing.

A terminal front stop 73 is located on polarizing projection 70 as shown in FIG. 13. Such a polarizing projection facilitates proper orientation of the receptacle terminal in a connector housing while the front stop helps to control receptacle terminal insertion. A terminal front stop 173 could be located on top wall 51 as shown in FIG. 14. Either terminal front stop 73, 173 engages a surface of connector housing 80 as receptacle terminal 20 is fully inserted into connector housing 80, thereby preventing receptacle terminal 20 from being inserted any further into connector housing 80.

FIG. 13 further shows an embodiment of a receptacle terminal 20 with a terminal position assurance member. After receptacle terminal 20 is fully inserted into connector housing 80 and primary locking member 82 engages with primary lock up surface 72, a terminal position assurance member, generally designated 92, can be inserted into connector housing 80. In the illustrated embodiment, this terminal position assurance member 92 can be considered a front or an end terminal position assurance member. The illustrated member 92 includes a projecting portion 96 and a support portion 98 that allows for securement of the terminal position assurance member 92 to the assembly while the projecting portion 96 is within open space 97 adjacent the primary locking member 82. In this way, the terminal position assurance member 92 restricts outward movement of the primary locking member 82. Any such movement is less than that needed to disengage the primary locking member 82. More specifically, front terminal position assurance member 92 prevents primary locking member 82 from disengaging with primary lock up surface 72. Thus this front terminal positioning member can be considered a blocking member having a blocking surface 99.

Alternatively, as shown in FIG. 14, an embodiment of receptacle terminal 20 has a secondary locking member that is a terminal position assurance member, generally designated 94, that can be considered a side terminal position assurance member having blocking surface 199. This member 94 is inserted into an opening 198 into the connector housing 80 that is generally adjacent to the secondary lock up surface 74. After receptacle terminal 20 is fully inserted into connector housing 80 and primary locking member 82 engages with primary lock up surface 72, the terminal position assurance member 94 is inserted through the opening 198. Insertion continues until the blocking surface 199 of terminal position assurance member 94 is in position to engage secondary lock up surface 74. Typically, such engagement occurs if force is put on receptacle terminal 20 in the opposite direction of the insertion direction, thereby preventing receptacle terminal 20 from substantial movement within connector housing 80.

Body portion 42 has side walls 49. A beam support 76 (FIGS. 1, 3, 6, 6A and 7-11) projects from a housing side wall 49 to provide support to each primary contact beam 50 and the secondary beam 60. In the illustrated embodiment, a flap support 78 (FIGS. 1, 3, 4, 6, 6A and 7-11) also projects from a housing side wall 49 to provide support to the protective flap 56. A tab 58 (FIG. 2) extends down from a portion of top wall 51 to prevent deformation of top wall 51 from excessive force, such as terminal nose stubbing during insertion of the receptacle terminal into a housing for example. The bottom edge 59 of tab 58 engages with housing side wall 49 as top wall 51 is biased downward.

Figure 8:
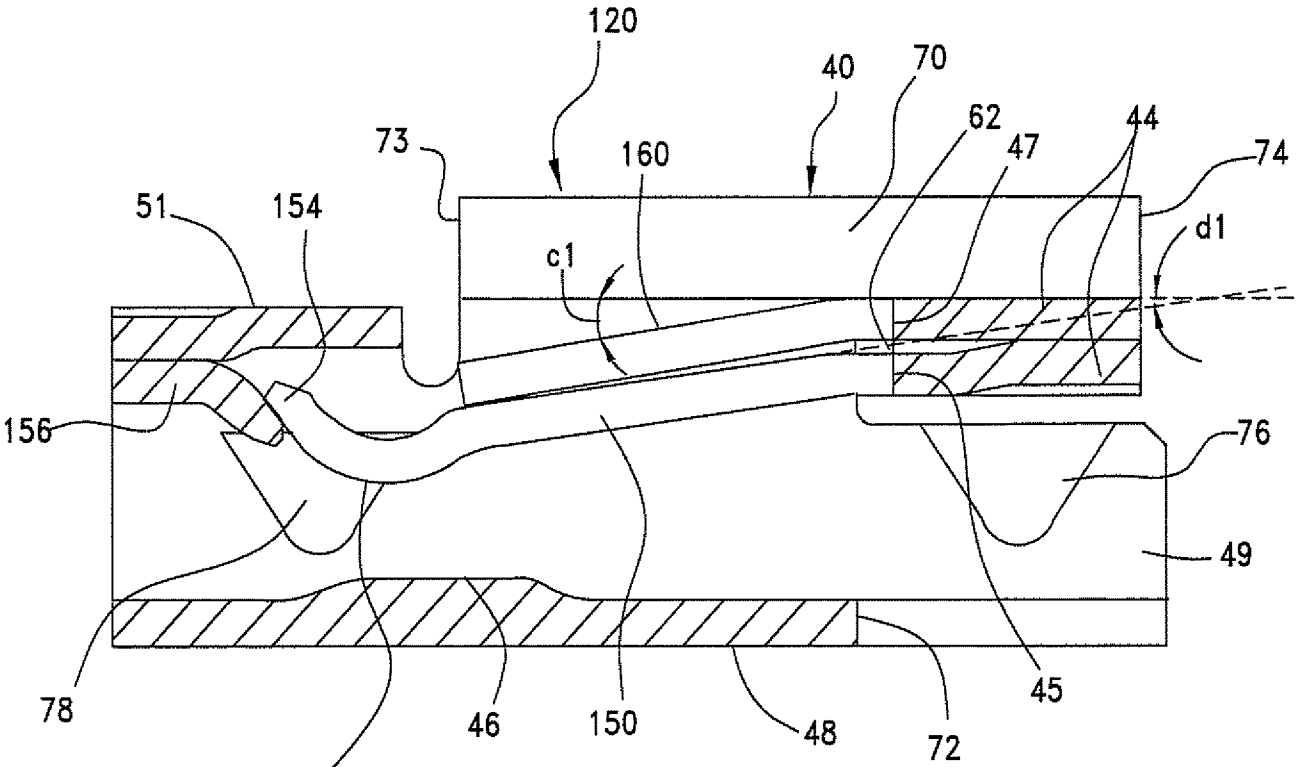
FIG. 8 is a partially cut away side elevation view of another embodiment of a miniature terminal receptacle that has a preloaded feature, shown in the unmated position.

In the illustrated embodiment shown in FIG. 8, unmated miniature receptacle terminal 120 has at least one primary contact beam 150, typically two primary contact beams 150 positioned in parallel within body 42. Primary contact beam or beams 150 are cantilevered from a first location on support platform 44. Primary beam or beams 150 extend from a longitudinal insertion axis 38 at an angle "d1." A secondary beam 160 is positioned above primary contact beam or beams 150. Secondary beam 160 is cantilevered from a second location on support platform 44. Secondary beam 160 extends from longitudinal insertion axis 38 at an angle "c1." In this embodiment, angle "c1" is larger than angle "d1" wherein a portion of secondary beam 160 makes contact with primary contact beams 150 in the unmated position. In a typical example, angle "c1" is between about 5 and 30 degrees, while angle "d1" is between about 1 and 25 degrees. As shown, the respective end portions of the respective beams 150 and 160 are spaced apart from each other where these end portions connect to support platform 44 by a selected distance 62 between first and second locations 45 and 47, while their respective free end lengths engage each other.

Figure 9:
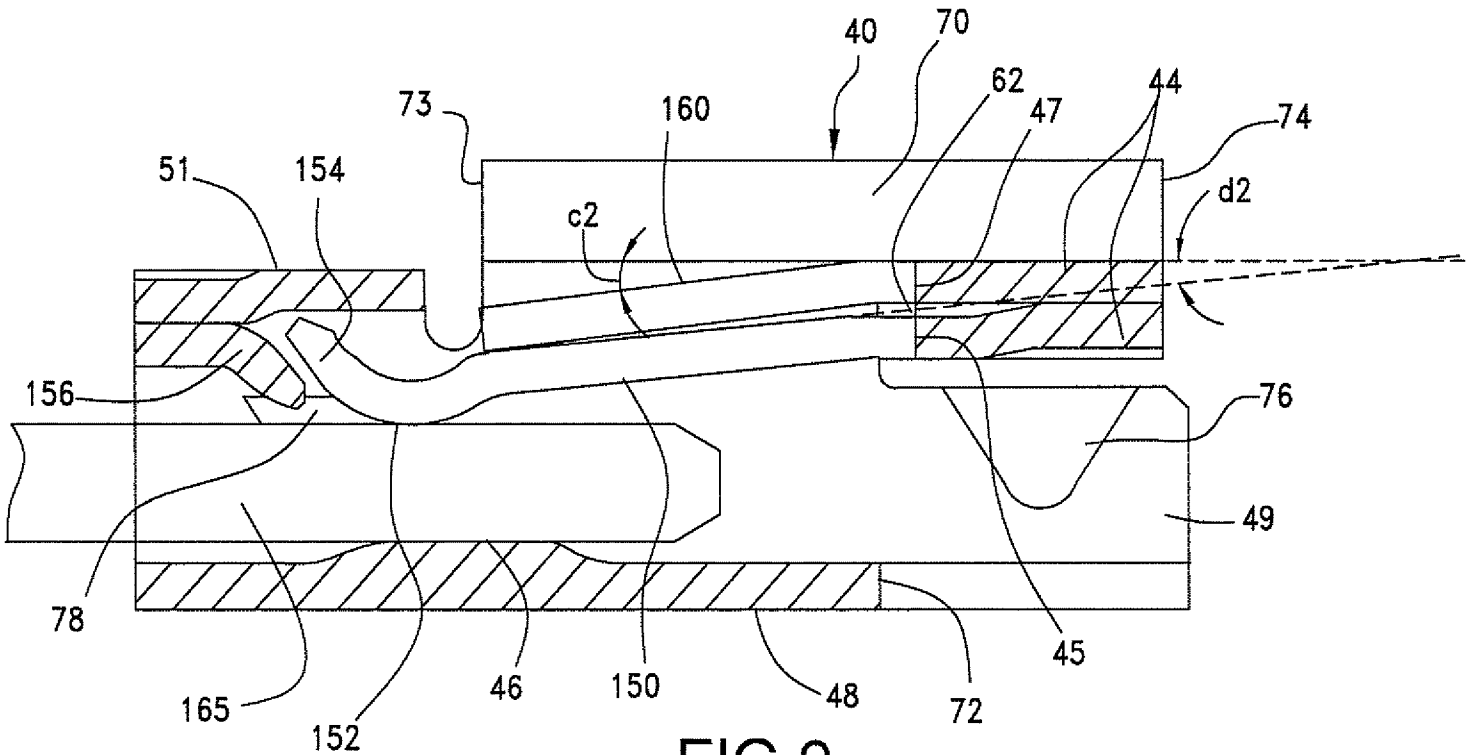
FIG. 9 is a partially cut away side elevation view of the miniature terminal receptacle shown in FIG. 8 in the mated position, shown with a pin inserted therein.

As shown in FIG. 8, an upwardly extending tip portion 154 is engaged with a protective flap 156 such that upwardly extending tip 154 is biased upward in a preloaded condition prior to insertion of a male pin 165 (FIG. 9). Such preloading of the primary contact beam or beams 150 may reduce the insertion force required to mate with male pin 165 due to the force component of the insertion load force of the beam or beams 150 that is taken up by the flap 156 as it engages the beam tip portion 154.

As shown in FIG. 9, contact beams 150 further have a contact surface 152 that engages male pin 165 when mating. The tip portion 154 of the contact beam 150 has an upwardly extending tip end to aid in guiding male pin 165 during insertion and to protect the pin and contact beams 150 from damage. To provide overstress protection, upwardly extending tip portion 154 can engage the interior surface of top wall 51 when male pin 165 is inserted, thereby preventing contact beams 150 and top beam 160 from overextending in the upward direction. This engagement can also improve connection integrity by providing flexure and bias against the inserted pin 165 that is generated by engagement between tip portion 154 and wall 51. Housing 42 also has a protective flap 156 to further aid in guiding male pin 165 during insertion and to protect the pin and contact beams 150 from damage.

Figure 10:
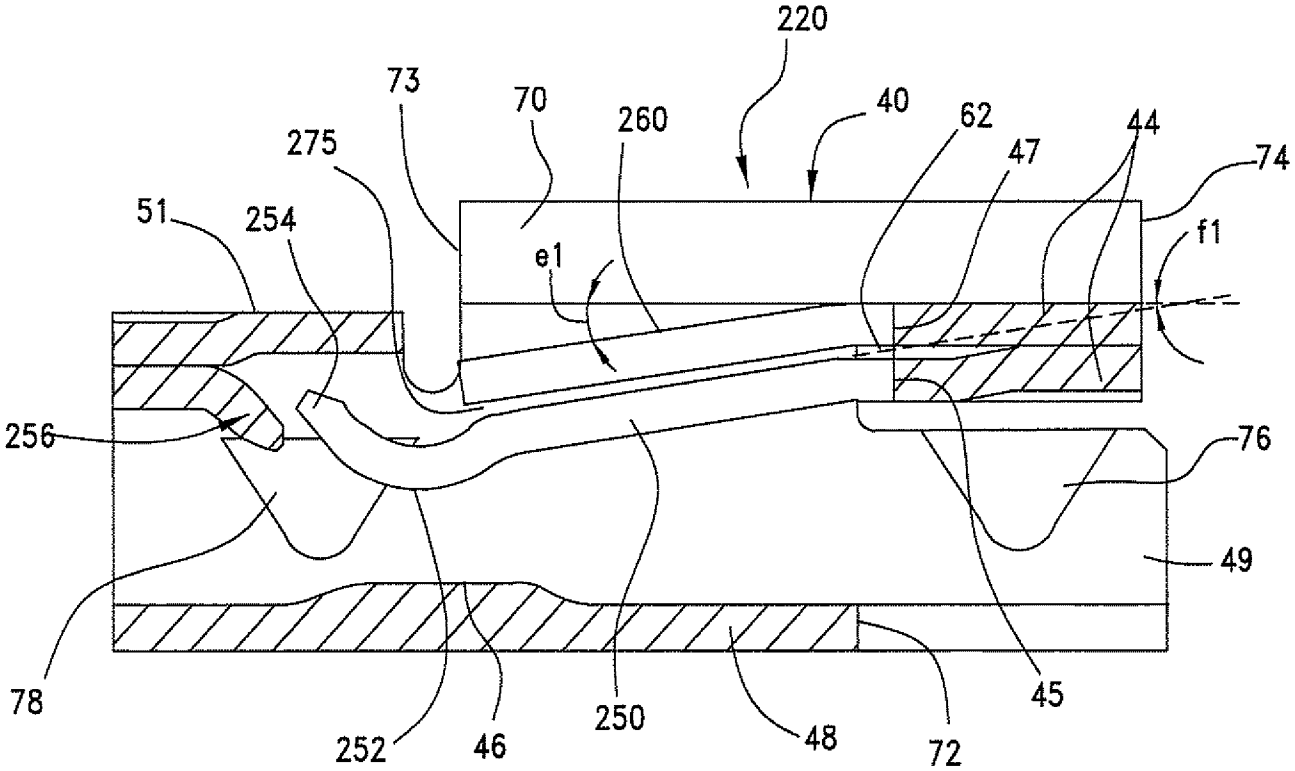
FIG. 10 is a partially cut away perspective view of a further embodiment of a miniature terminal receptacle.

In the illustrated embodiment shown in FIG. 10, unmated miniature receptacle terminal 220 has at least one primary contact beam 250, typically two primary contact beams 250 positioned in parallel within body 42. Primary contact beam or beams 250 are cantilevered from a first location on support platform 44. Primary beam or beams 250 extend from a longitudinal insertion axis 38 at an angle "f1." A secondary beam 260 is positioned above primary contact beam or beams 250. Secondary beam 260 is cantilevered from a second location on support platform 44. Secondary beam 260 extends from longitudinal insertion axis 38 at an angle "e1." In this embodiment, angle "e1" and angle "f1" are sized such that there is a beam gap 275 between secondary beam 260 and primary contact beam 250 in the unmated position. In the embodiment that is illustrated in FIG. 10, this gap 275 begins at the selected distance 62 and extends the full length of the secondary beam 260. In a typical example, angle "e1" is between about 1 and 30 degrees, and angle "f1" is between about 1 and 30 degrees.

Figure 11:
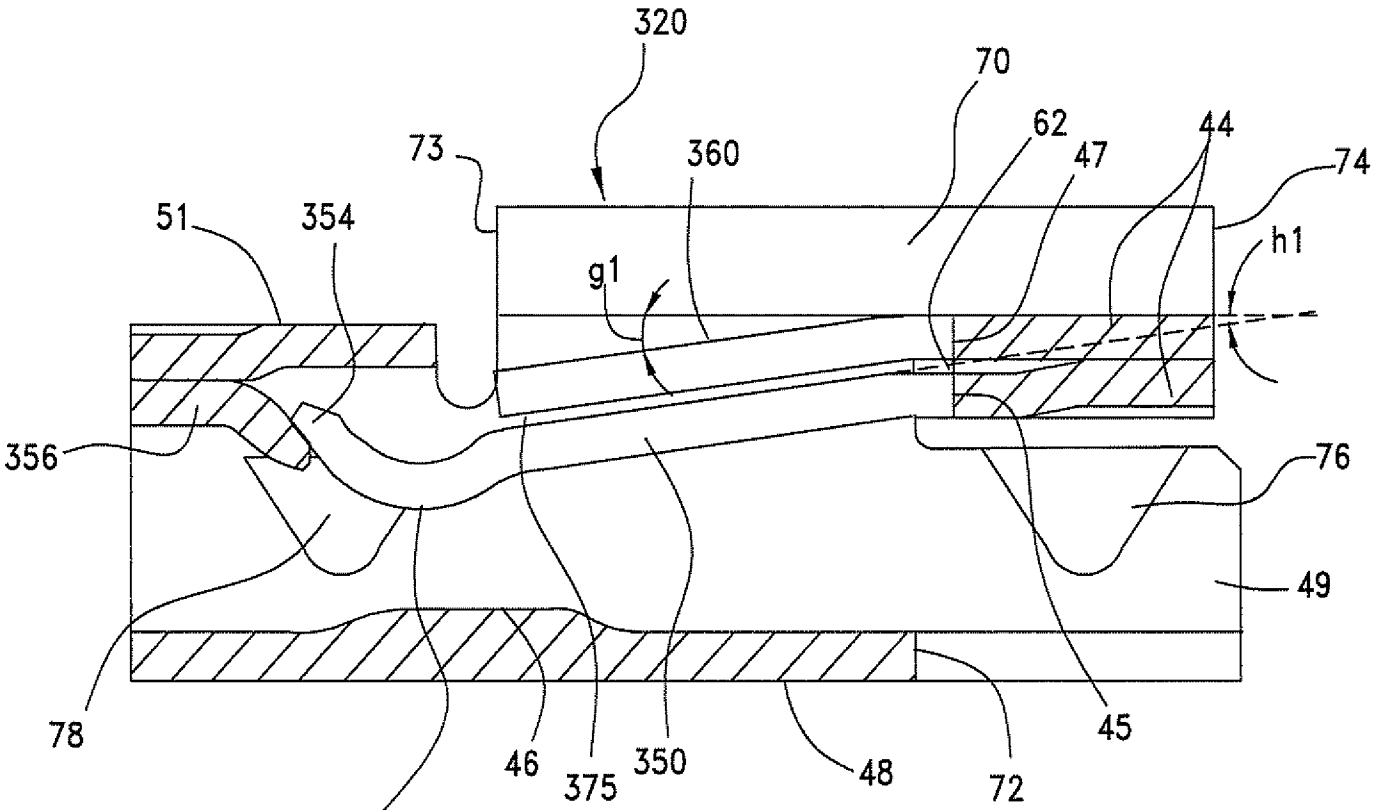
FIG. 11 is a partially cut away perspective view of another embodiment of a miniature terminal receptacle.

In the illustrated embodiment shown in FIG. 11, unmated miniature receptacle terminal 320 has at least one primary contact beam 350, typically two primary contact beams 350 positioned in parallel within body 42. Primary contact beam or beams 350 are cantilevered from a first location on support platform 44. Primary beam or beams 350 extend from a longitudinal insertion axis 38 at an angle "h1." A secondary beam 360 is positioned above primary contact beam or beams 350. Secondary beam 360 is cantilevered from a second location on support platform 44. Secondary beam 360 extends from longitudinal insertion axis 38 at an angle "g1." In this embodiment, angle "g1" and angle "h1" are sized such that there is a beam gap 375 between secondary beam 360 and primary contact beam or beams 350 in the unmated position. An upwardly extending tip portion 354 is engaged with a protective flap 356 such that upwardly extending tip portion 354 is biased upward in a preloaded condition prior to insertion of a male pin (not shown). Such preloading of the primary contact beam or beams 350 may reduce the insertion force required to mate with a male pin (not shown) due to the force component of the insertion load force of the beam or beams 350 that is taken up by the flap 356 as it engages the beam tip portion 354. In a typical example, angle "g1" is between about 1 and 30 degrees, and angle "h1" is between about 1 and 30 degrees.

As shown in FIG. 12, unmated miniature receptacle terminal 20 is inserted into a connector housing 80. A primary locking member 82 engages with primary lock up surface 72 to hold the miniature receptacle terminal 20 in place. Other interactions between the miniature receptacle terminal 20 and the connector housing 80 also are shown. It will be appreciated that the connector housing 80 is insulative or of a dielectric material while the miniature receptacle terminal is conductive.

It will be understood that there are numerous modifications of the illustrated embodiments described above which will be readily apparent to one skilled in the art, such as many variations and modifications of the miniature receptacle terminals and/or its components including combinations of features disclosed herein that are individually disclosed or claimed herein, explicitly including additional combinations of such features, or alternatively other types of miniature receptacle terminals. Also, there are many possible variations in the materials and configurations. These modifications and/or combinations fall within the art to which this approach relates and are intended to be within the scope of the claims, which follow.

What is claimed is:

1. A receptacle terminal comprising:

a body portion, the body portion having a longitudinal insertion axis and having a connection section along an end portion of the receptacle terminal and a mating section extending away from the connection section, the mating section being configured to mate with a complementary terminal;

two contact beams cantilevered from a first location on the body portion, the two contact beams being side-by-side with respect to each other, at least a portion of the contact beams extending at a first angle from the longitudinal insertion axis into the receptacle terminal wherein a free end portion of the contact beams has a first concave portion and an end edge;

a stiffening beam cantilevered from a second location on the body portion and into the receptacle terminal, the first and second locations being separated by a selected distance between the first and second locations, at a second angle from the longitudinal insertion axis into the receptacle terminal, the contact beams being positioned between the stiffening beam and the longitudinal insertion axis;

wherein the second angle is larger than the first angle;

at least one bump protruding into the connector from a wall of the body portion wherein the bump opposes the contact beams;

a flap extending into the receptacle terminal wherein the flap extends further down into the mating section than the end edge of the contact beams;

wherein the free end portion of the contact beam and a free end portion of the stiffening beam are spaced apart prior to insertion of the terminal.

2. The receptacle terminal according to claim 1, wherein the first angle is between about 5 degrees and 30 degrees and wherein the second angle is between about 1 degree and 25 degrees.

3. The receptacle terminal according to claim 1, wherein the flap is spaced apart from the contact beam prior to insertion of the terminal.

4. The receptacle terminal according to claim 1, wherein the flap contacts the contact beam prior to insertion.

5. A receptacle terminal connector comprising:

a dielectric connector housing;

a miniature receptacle terminal supported by the dielectric housing;

a body portion of the miniature receptacle terminal, the body portion having a longitudinal insertion axis and having a connection section along an end portion of the terminal and a mating section extending away from the connection section, the mating section being configured to mate with a complementary terminal, a polarizing surface extending from the body portion of the miniature receptacle terminal, wherein during insertion of the miniature receptacle terminal within the dielectric housing, a stop surface on a front end of the polarizing surface engages with a blocking surface on the dielectric housing;

at least one contact beam cantilevered from a first location on the body portion, at least a portion of the contact beam extending at a first angle from the longitudinal insertion axis into the receptacle terminal wherein a free end portion of the contact beam has a first concave portion and an edge;

a stiffening beam cantilevered from a second location on the body portion and into the receptacle terminal, the first and second locations being separated by a selected distance between the first and second locations, at a second angle from the longitudinal insertion axis into the connector, the contact beam being positioned between the stiffening beam and the longitudinal insertion axis;

the second angle is larger than the first angle; and a flap extending into the connector wherein the flap extends further down into the mating section than the end edge of the contact beam.

6. The receptacle terminal connector according to claim 5, further comprising at last one bump protruding into the receptacle terminal from a wall of the body portion wherein the bump opposes the contact beam.

7. The receptacle terminal connector according to claim 5 or 6, wherein the body portion has a first locking surface and a second locking surface for engaging the dielectric housing.

8. The receptacle terminal connector according to claim 7, further including a primary locking member that is engaged with the first locking surface and a second locking member that restricts movement of the primary locking member.

9. The receptacle terminal connector according to claim 8, wherein the second locking member restricts movement of the miniature receptacle connector within the dielectric connector housing upon engaging the second locking surface.

10. The receptacle terminal connector according to claim 5, further comprising a polarizing surface extending from the body portion of the miniature receptacle connector.

11. The receptacle terminal connector according to claim 5, wherein during insertion of the miniature receptacle terminal within the dielectric connector housing, a stop surface on the miniature receptacle terminal engages with a blocking surface on the dielectric connector housing.

12. The receptacle terminal connector according to claim 11, wherein the stop surface on the miniature receptacle connector is a portion of the front edge of the mating section.

* * * * *